US005723781A

United States Patent [19]

Pruett et al.

[11] Patent Number: 5,723,781

[45] Date of Patent: Mar. 3, 1998

[54] BOREHOLE TRACER INJECTION AND DETECTION METHOD

[76] Inventors: Phillip E. Pruett, 12417 Hwy. 178, Bakersfield, Calif. 93306; Mitchell Findlay, 11526 E. Banyon Rim Dr., Whittier, Calif. 90601

[21] Appl. No.: 696,325

[22] Filed: Aug. 13, 1996

[51] Int. Cl.[6] ..... E21B 47/10

[52] U.S. Cl. ..... 73/152.18; 73/152.39; 250/260

[58] Field of Search ..... 73/152.39, 152.37, 73/152.18, 152.01; 250/259, 260, 303; 166/250.01, 252.1, 252.6, 250.08

[56] References Cited

U.S. PATENT DOCUMENTS

| | | | |
|---|---|---|---|
| 2,495,736 | 1/1950 | Krasnow et al. | 250/260 |
| 3,712,129 | 1/1973 | Rhoades | 73/151 |
| 3,722,589 | 3/1973 | Smith et al. | 166/250.01 |
| 3,880,234 | 4/1975 | Showalter et al. | 166/251 |
| 3,895,527 | 7/1975 | McArthur | 73/151 |
| 3,898,877 | 8/1975 | McArthur | 73/151 |
| 3,985,027 | 10/1976 | Tricon | 73/151 |
| 4,010,642 | 3/1977 | McArthur | 73/151 |
| 4,616,705 | 10/1986 | Stegemeier et al. | 166/250 |
| 4,817,713 | 4/1989 | Nguyen et al. | 166/252.6 |
| 4,832,121 | 5/1989 | Anderson | 166/254 |
| 4,976,142 | 12/1990 | Perlas | 73/155 |
| 5,191,210 | 3/1993 | Pauley et al. | 250/260 |
| 5,275,038 | 1/1994 | Sizer et al. | 73/152.02 |

*Primary Examiner*—Michael Brock
*Attorney, Agent, or Firm*—Don E. Erickson

[57] ABSTRACT

The present invention generally pertains to apparatus and a method for continuously injecting a tracer in a borehole to thereby enable continuously measuring the flow of effluents in the borehole, i.e. either in an injection well or production well, of an oil, gas or geothermal field. The apparatus and method comprises positioning capillary tubing within the borehole, the tubing having a flowpath extending continuously from the surface to a desired depth, the capillary tubing having at least one sensor suspended in the borehole at the desired depth, injecting a tracer element into the tube from a pressurized source at the surface, releasing the tracer element at the desired depth and detecting the presence of the tracer.

31 Claims, 3 Drawing Sheets

BOREHOLE TRACER INJECTION AND DETECTION METHOD

FIELD OF THE INVENTION

This invention generally pertains to profiling oil, gas and geothermal fields, and more particularly to measuring flow parameters in the borehole, i.e. either an injection well or a production well, of such oil, gas or geothermal field utilizing tracer elements injected into the borehole.

BACKGROUND OF THE INVENTION

The prior art is replete with techniques for introducing tracer elements into steam injected from the surface into production or injection wells. Such methods of injection have not proved to be totally satisfactory for profiling subterranean fields for determining flow parameters due to the fact that the tracer becomes dispersed in the effluent, reducing the reliability of detected conditions. Current techniques for profiling steam injection wells use a radioactive gas tracer, typically Krypton-85, or Xenon-133. A tracer slug is injected into the steam injection line at the surface, and is carried down hole with the steam flow. A logging tool with gamma ray detectors is suspended on a cable opposite the interval where steam is intended to exit the well bore. Two detectors, separated by a known distance (usually about 6 feet), monitor the tracer slug's transit down the well bore. Since the velocity of the tracer is quite high, the logging tool is held stationary during monitoring, and only one velocity check can be performed for each slug of tracer injection. A profile of the effluent flow of a well is constructed by moving the logging tools to other depths and monitoring other slugs of tracer shot from the surface.

Certain disadvantages are inherent in known surface injection techniques. Surface injecting multiple slugs of radioactive tracer is a slow process exposing the logging personnel to elevated levels of radiation. A surface injected slug of tracer may take some time to traverse the first 1,000 to 2000 feet of well bore prior to reaching the detectors. This transit in a steam/water mixture of varying ratios tends to diffuse and spread the tracer. Diffuse tracer does not pass the detectors cleanly or evenly, making the detection of tracer somewhat subjective and resulting in lessened velocity measurement accuracy. Tracer measurements near the bottom of an injection interval, i.e., the vertical part of the oil bearing zone that the injection well is intended to influence, are even more difficult to obtain accurately. If most of the steam (and tracer) has exited in the upper portions of the injection interval, there will not be much tracer left in the well flow for the detectors to read easily. And, since the steam (and tracer) will be moving slower near bottom, the slow transit time will add to the difficulties of measurement and accuracy of the data. Typically, the technician will inject more tracer when monitoring the lower reaches of the well to overcome losses experienced in shallower portions of the well.

U.S. Pat. No. 5,191,210 to Pauley et al describes a device and method for determining the flow of steam entering a production well by the injection of a radioactive gas from a source contained within a sonde, or logging tool, when such sonde is lowered in the production well. The radioactive gas is contained in glass vials and released by breaking the vials in a controlled manner. Such methods encounter significant obstacles in actual field use and have not been widely accepted in the industry. First, the conditions in which the sonde is lowered are extremely hostile and volatile, and breakage of the source vials may occur while lowering the sonde to the desired depth in the production well. Second, only a limited amount of radioactive gas may be contained within the sonde. Hence, the sonde must be returned to the surface when the limited amount of radioactive gas is exhausted. Third, frequent replacement of the vials containing the radioactive gas may expose the workmen to excessive amounts of harmful radiation.

U.S. Pat. No. 3,712,92 describes the use of an open-ended gas charged tube which enables the periodic measuring of pressure in a borehole. U.S. Pat. No. 4,976,142 to Perales, which patent is incorporated herein by reference, discloses various references which teach the use of capillary tubing in pressure measurement. However, none of the references cited therein suggest that capillary tubing may be used for the metered insertion of tracer elements.

SUMMARY OF THE INVENTION

The present invention describes an apparatus and method for continuously injecting a tracer element in a borehole, thereby enabling the continuous measurement of the flow of effluents in the borehole. The method comprises inserting a capillary tubing in the borehole, the capillary tubing containing sensing means, pressure injecting through the capillary tubing a tracer element; and detecting the presence of the tracer element with the sensing means. The simplicity of the apparatus and method facilitates their use in steam, oil, gas and geothermal wells. The invention overcomes disadvantages of the prior art in that, first, the tracer source is positioned on the surface and metered into the capillary tube, and hence to the logging tool in controlled bursts, thus eliminating any accidental discharge of the tracer. Second, since the tracer element is transported to its release point by capillary tubing, breakage of the tracer source cannot occur. Third, since the tracer element can be transported through the capillary tubing in a continuous and unlimited stream, retrieving the logging tool to replenish the tracer source is not necessary. Subsurface injection of tracer is an easy, quick, and safe procedure. Tracer slugs are injected by simply turning a valve to push a gas such as, but not limited to, non radioactive nitrogen into the capillary tubing supporting the logging tools. Subsurface injection of tracer from dispersion ports within several feet of the detectors will be an instantaneous procedure taking only seconds instead of minutes. Vagaries of the flow regime up to the surface will not affect the tracer that is injected near bottom. Smaller doses of tracer can be used since there will be very little diffusion across the detectors. It is estimated that only half of the original mount of tracer will be necessary. This will result in a $10 to $20 savings per shot of tracer (typically, 10 shots per well are used).

Other advantages of the invention will become apparent upon review of the drawings and descriptions that follow. Not all the advantages specifically stated herein necessarily apply to every embodiment of the invention. Further, such stated advantages of the invention are only exemplifications and should not be construed as the only advantages of this invention. Additional features of the present invention are described with reference to the drawings and detailed description of the preferred embodiments.

DETAILED DESCRIPTION

Figures 1, 3:
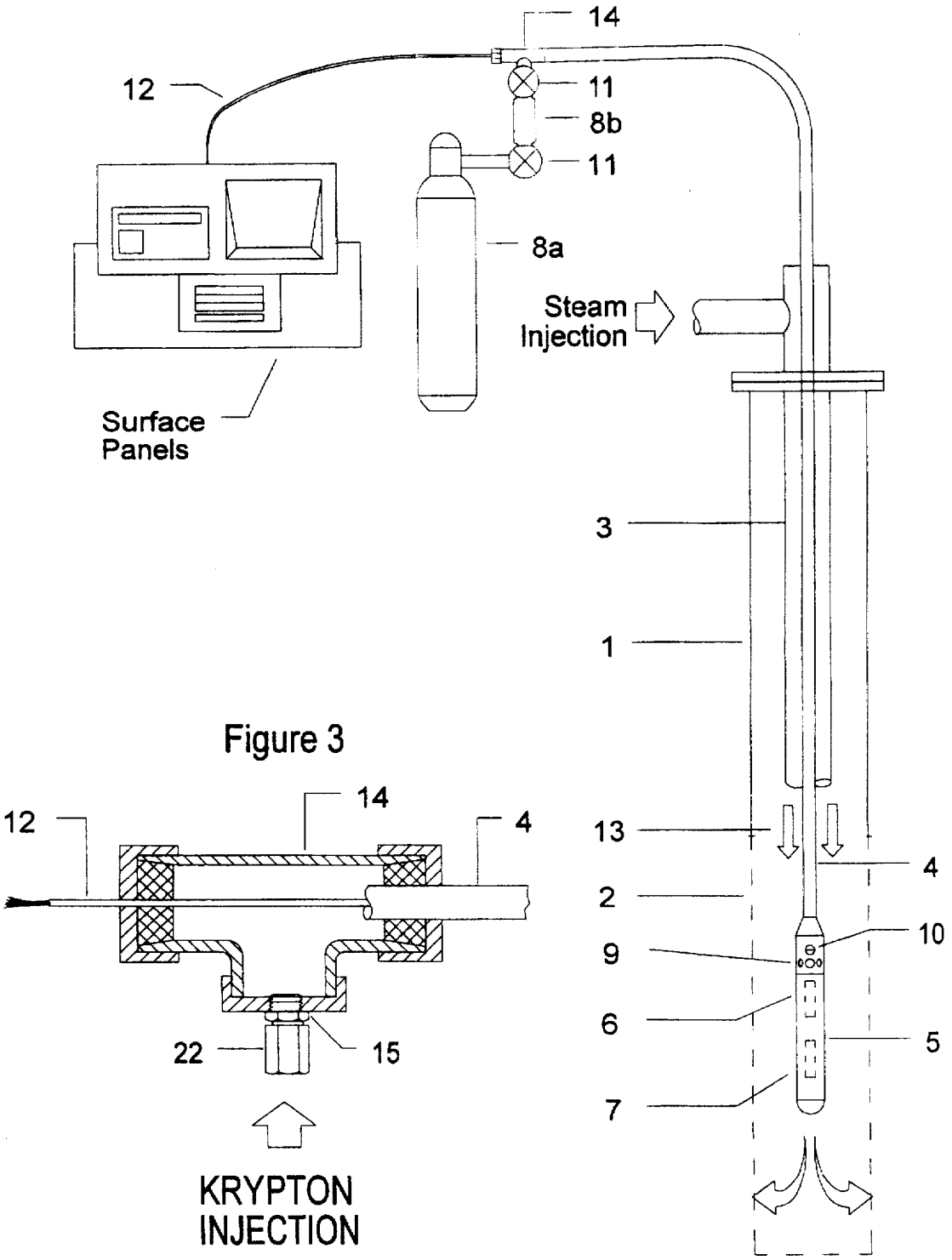
FIG. 1 is a pictorial view, partially in cross-section, of the tracer injection system according to the present invention in a wellbore of an injection well with steam injection from the surface.
FIG. 3 is a cut-away view of a first tee connector for inserting the tracer and an electrical wire in a capillary tube.

FIG. 1 illustrates a typical wellbore extending into an underground formation with steam injection from the surface of the well casing. A casing 1 is positioned in the wellbore, such casing having perforations 2 at its lower end to permit the entry of fluid into the formation. Production tubing 3 extends from the wellhead at the surface to a selected depth in the borehole. In a most basic embodiment, the tracer is injected through the capillary tube 4 to the selected depth and released, the downhole end of capillary tube 4 then being the release port. In the embodiment of FIG. 1, tool or instrument housing 5 extending from the capillary tubing 4 includes two spaced apart detectors 6 and 7 for detecting the presence of tracer elements at tracer release port 9, and a check valve 10 to control the release of tracer into the wellbore. Capillary tube 4 in accordance with the present invention extends from the surface to a release point above the housing 5. Typical, capillary tube 4 is constructed of 316 stainless steel, comprising a main tube of 0.250 inch outside diameter with 0.028 inch wall thickness and an 0.184 inch inside diameter, however, the size of the tubing is not critical to the operation of the invention, and other capillary tubing may be used, provided that the capillary tubing would typically be subjected to a working pressure of 4200 psi with a tensile load of 75,000 psi. The capillary tubing is attached to a drum, or spool, at the surface by mechanical means well known in the industry and is inserted into the casing 1 to the selected depth. A tracer injection system at the surface for injecting the tracer into the capillary tube 4 comprises a pressure source 8*a*, a tracer container 8*b* and an injection tee 14, whereby the entrained tracer element is injected into capillary tube 4. Pressures of tracer injection may range from 10 to 50 psi over wellhead injection pressures, which typically range from 100 to 1000 psi. The tracer element may be of any detectable element, however it is typical to use inert radioactive gas tracers, such as krypton 85 or xenon 133 for tagging steam. Since the viscosity of inert gas tracers and of injection gases do not vary substantially, various tracers and injection gases may be employed as long as the tracer strength is sufficient to penetrate the detector housing. For example, when the tracer element is radioactive, the half life must accommodate shipping and scheduling times, and the gamma radiation must be sufficiently strong to penetrate the housing for a gamma ray detector. When using the present invention for checking for possible flow or leakage outside the casing 1 it is preferable to use a radioactive tracer such as krypton, which has sufficiently powerful gamma rays to penetrate casing 1 or tubing 3. Liquid tracers may also be used, assuming their viscosity is such that it does not cause plugging of capillary tube 4. Standard steam injection apparatus, well known in the industry, is used to inject steam into the tubing 3, with the flow direction of the steam depicted by the arrows 13. The tracer is borne by the injected steam past the spaced apart detectors 6 and 7, enabling profiling of the wellbore parameters at the point of the detectors. In this exemplary embodiment, injection valves 11 at the surface control the mixture of source nitrogen 8*a* and tracer element 8*a*. Alternately, or in combination with injection valves 11, check valve 10 controls the injection of the tracer from the tracer release port 9. The check valve 10 is spring controlled. Electrical wire 12 contained within and extending along the capillary tube 4 is used to power and read detectors 6 and 7. The electrical wire 12 should be of a type that will sustain high temperatures. In the present invention 18 to 22 gauge copper wire with Teflon high temperature insulation is preferred. Alternatively, in this embodiment and all subsequent embodiments, the electrical power source for the sensors could be self-contained in the logging tool itself, such as with the use of batteries or alternate means of electric power generation known in the field.

Figure 2:
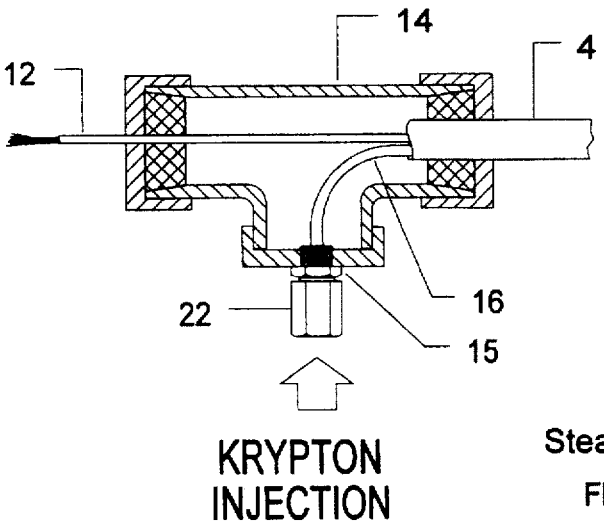
FIG. 2 is a pictorial view, partially in cross-section, of the tracer injection system according to the present invention in a wellbore of a producing well with steam entry at the bottom of the well.

FIG. 2 illustrates a typical wellbore extending into an underground formation with steam entry into the wellbore near the bottom of the well casing. As in the embodiment of FIG. 1, a casing 1 is positioned in the wellbore, such casing having perforations 2 at its lower end to permit the entry of fluid into the formation. Production tubing 3 extends from the wellhead at the surface to a selected depth in the borehole. Housing 5 extending from the capillary tubing 4 includes two spaced apart detectors 6 and 7 for detecting the presence of tracer elements at tracer release port 9, and a check valve 10 to control the release of tracer into the wellbore. Capillary tube 4 in accordance with the present invention extends from the surface to a release point above the housing 5. A tracer injection system at the surface for injecting the tracer into the capillary tube 4 comprises a pressure source 8*a*, a tracer container 8*b* and an injection tee 14, whereby the entrained tracer element is injected into the capillary tube 4. Steam injection into the production field, by means well known in the industry, causes steam to enter the casing 1 through the perforations 2, with the flow direction of the steam depicted by arrow 13. The tracer is borne by the produced steam past the spaced apart detectors 6 and 7, enabling profiling of the wellbore parameters at the point of the detectors. In this exemplary embodiment, injection valves 11 at the surface control the mixture of source nitrogen 8*a* and tracer element 8*b*. Alternately, or in combination with injection valves 11, check valve 10 controls the injection of the tracer from the tracer release port 9. The check valve 10 is spring controlled. As in the first embodiment, electrical wire 12 contained within and extending along the capillary tube 4 is used to power and read detectors 6 and 7.

Figure 4:
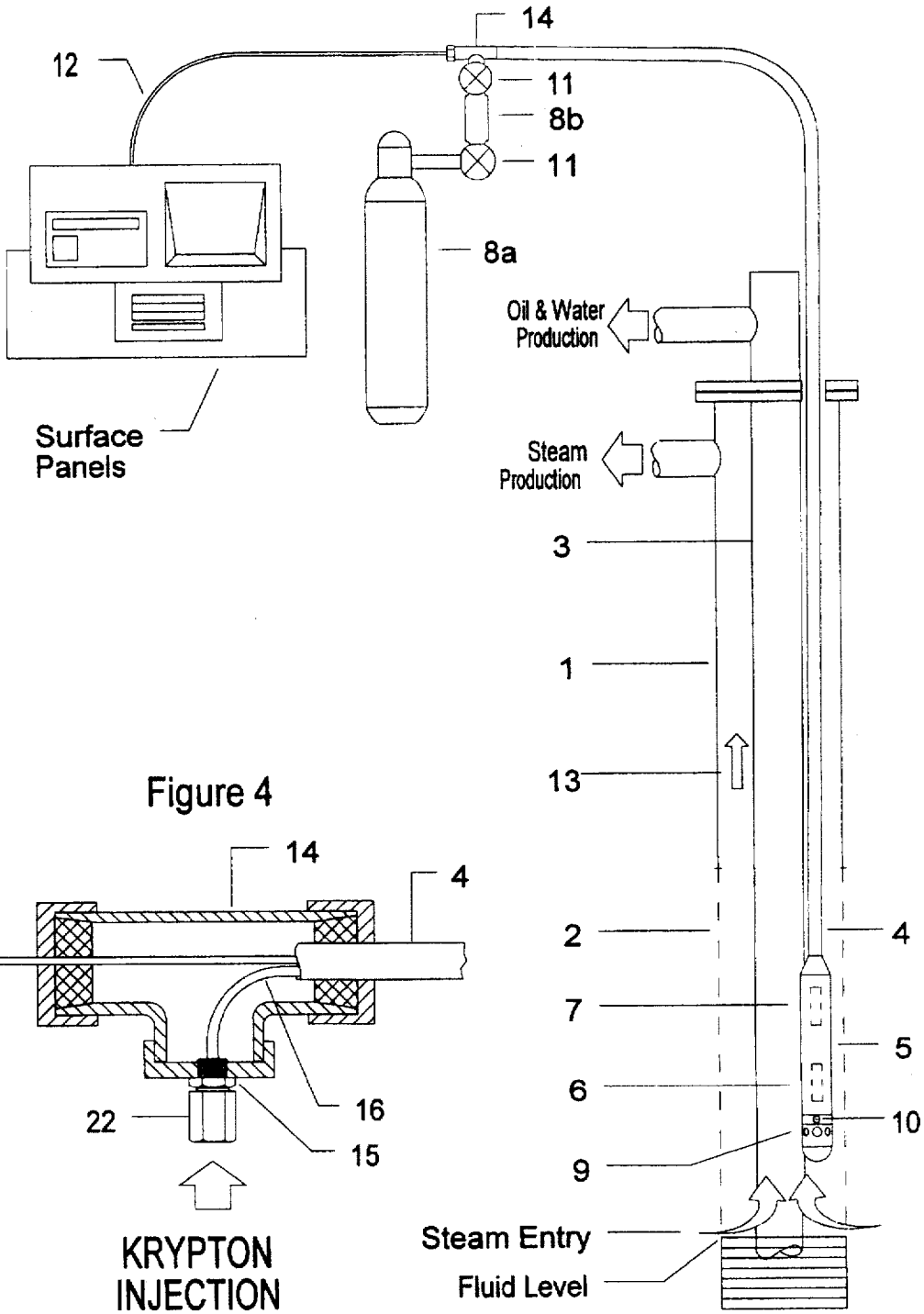
FIG. 4 is a cut-away view of a second tee connector for inserting the tracer and an electrical wire in a capillary tube.

FIG. 3 is a cut-away, pictorial view of the tee connector 14 of the apparatus of FIGS. 1 and 2. Orifices are drilled and tapped to receive male connectors, which connectors are well known by one of ordinary skill in the industry. The male connectors are sealably, threadedly inserted in the housing for receipt of the capillary tubing. FIG. 3, shows an optional electrical wire 12 extending through the body of the housing 14 and through the capillary tube 4 to the selected depth in the borehole. Injection of the tracer through capillary tube 4 is effected by injecting under pressure the tracer through male connector 15. FIG. 4 is a cut-away, pictorial view of the tee connector 14 of FIG. 3 in which a smaller diameter capillary tube 16, of approximately 0.94", is inserted in the larger capillary tube 4 and the injection tee 14 is modified to enable the injection of the mixture of source nitrogen 8*a* and tracer element 8*b* into the smaller diameter capillary tube 16.

Figure 5:
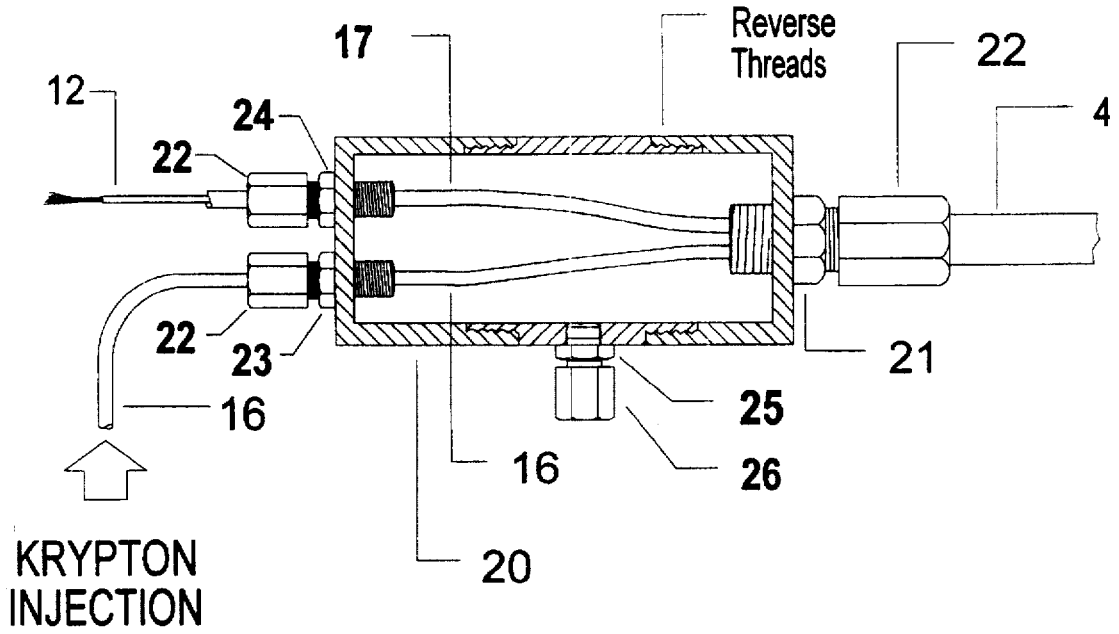
FIG. 5 is a cut-away view of a third alternate connector for inserting the tracer in a capillary tube.
Figure 6:
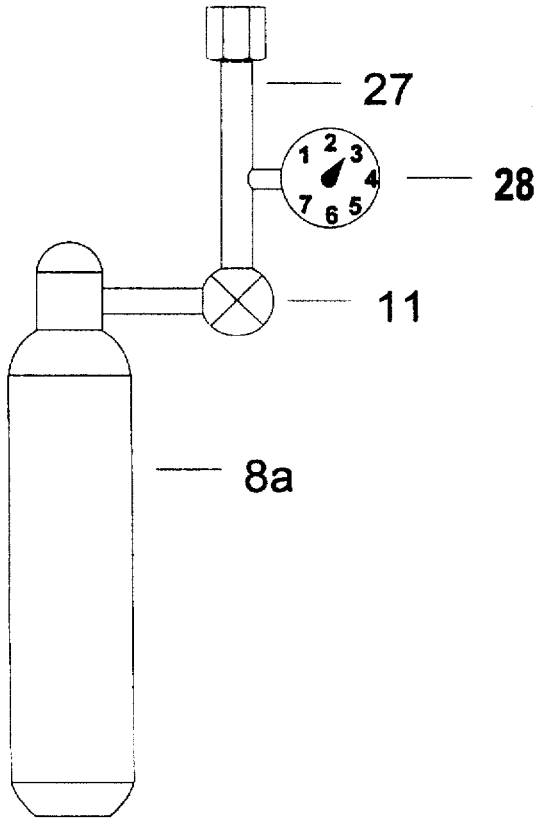
FIG. 6 is a pictorial view of pressure injection system.

FIG. 5 is a cut-away view of a connector housing 20, such housing comprised of three parts which may be threadably assembled. Such types of connector housings are well known by those of ordinary skill in the art. Connector housing 20 is generally cylindrical in shape, with the central portion of the connector housing 20 having standard threads on one end for receiving one end portion of the housing, and with the central portion having reverse threads on its opposing end for receiving the other end portion of the housing. In the exemplary connector of FIG. 5, a male connector 21 for pipe to tube connection is sealably inserted in one end of the connector for receiving the capillary tube 4 of FIGS. 1, 2, and 3. The capillary tube 4 is sealable connected to male connector 21 by means of compression nut 22. First and second male connectors 23, 24 are disposed on the side of connector 20 opposing capillary tube 4, the male connector 23 for receiving capillary tube 16 and male connector 24 for receiving electrical wire 12. Capillary tube 16 is the smaller diameter capillary tube (approximately 0.94") of FIG. 4. Capillary tube 16 is inserted in the larger capillary tube 4 and extends to the selected depth in the borehole. The mixture of source nitrogen 8*a* and tracer element 8*b* is injected into the smaller diameter capillary tube 16 through male connector 23. Optionally, a second smaller diameter capillary tube 17 extends from the interior portion of male connector 24 and extends through capillary tube 4 to the selected depth in the borehole. Electrical connector 12 can then be inserted through male connector 24 and capillary 17 to the selected depth. The connector 20 may additionally have a fourth orifice drilled and tapped in its housing to receive a fourth male connector 25 for attachment to a second pressurized gas supply to enable for example, the measurement of pressure in the borehole at the selected depth. Male connector 25 would typically have a blind cap 26 sealably threaded on male connector 25 when not in use. FIG. 6 is a pictorial representation of a nitrogen gas supply 8*a* sealably, threadedly connected directly to male connector 25 using nipple 27, wherein gas is released into the connector 20 housing by means of valve 11 through nipple 27. The gas is then forced down the annulus of capillary tube 4. Pressure can easily be determined knowing the pressure of injection at pressure monitoring gauge 28, the depth of capillary tube 4, and the cross-sectional area of capillary tube 4 less the combined cross-sectional areas of capillary tubes 16 and 17. Alternatively, a fluid containing a second tracer element, different from the first tracer, may be injected through male connector 25 and thereby into the annulus of capillary tube 4. In such case the gas supply of FIG. 6 may or may not be nitrogen, but would contain the second tracer element. It is also contemplated that a second small diameter capillary tubing 17 be inserted into capillary tube 4 of FIGS. 3 and/or 4 for the encapsulation of electrical wire 12. Thus, in the embodiment of FIG. 3 the tracer would be injected in the annulus between the outside surface of capillary tube 17 and the inner surface of capillary tube 4. Concomitantly, in the embodiments of FIGS. 4 and 5 additional tracer and/or fluid may be inserted in the annulus between the outside surfaces of the smaller diameter capillary tubes 16 and 17 and the inner surface of capillary tube 4. Although the above embodiments utilize capillary tubing of 0.250" and 0.094" outside diameters, it is contemplated that capillary tubing of various sizes may be used under varying circumstances.

While the present description contains many specificities, these should not be construed as limitations on the scope of the invention, but rather as an exemplification of one/some preferred embodiment/s thereof. Many other variations are possible, for example, since the distance from the tracer release port 9 to a first sensor is known, only one sensor need be employed. The tracer release port 9 may additionally include a loading chamber for holding a selected amount of tracer element to be metered into the wellbore. And, although the preferred embodiments utilize valves 10 and 11 for the control and injection of the tracer element 8*b*, other means of injection control may be employed with the present invention.

Concomitantly, in the preferred embodiments nitrogen gas was the fluid used to pressurize the capillary tubing, however, other gases, such as helium, and other fluids, may be employed. It is also contemplated that other pressure systems, such as utilizing a pressure vessel with a propellant such as nitrogen inserted downhole and wherein the tracer is released by an electrically activated valve from the surface, may be employed for the injection of the tracer element. Accordingly, the scope of the invention should not be determined by the specific embodiments illustrated herein. The full scope of the invention is further illustrated by the claims appended hereto.

We claim:

1. Apparatus for continuously injecting and detecting the presence of a tracer in a borehole, the apparatus comprising:

(a) a first capillary tube positioned within the borehole extending continuously from the surface to a selected depth and providing a flowpath for the tracer:

(b) a pressurized source at the surface, in fluid communication with the first capillary tube, for injecting the tracer into the first capillary tube;

(c) a tracer release port, in fluid communication with the first capillary tube, the tracer release port for releasing the tracer element at the selected depth; and (d) at least one sensor for detecting the presence of the tracer, the sensor connected to the first capillary tube, and suspended in the borehole at the selected depth.

2. The apparatus of claim 1 wherein the tracer release port comprises one or more valves.

3. The apparatus of claim 2 wherein one valve is located at the downhole end of the first capillary tube.

4. The apparatus of claim 1 wherein the sensor is a gamma radiation detector.

5. The apparatus of claim 1 additionally comprising:

(e) a source of electrical power, the electrical power for operating the sensor.

6. The apparatus of claim 5 wherein the source of electrical power is a battery.

7. The apparatus of claim 5 wherein the source of electrical power is comprised of at least one electrical wire positioned within the first capillary tube and extending from the surface to the sensor, the electrical wire for communicating electrical power to the sensor.

8. The apparatus of claim 7 additionally comprising:

(f) a second capillary tube, inserted in the first capillary tube, the second capillary tube extending from the surface to the sensor, the second capillary tube encapsulating the electrical wire.

9. Apparatus for continuously injecting a tracer in a borehole, the apparatus comprising:

(a) a first capillary tube positioned within the borehole, extending continuously from the surface to a selected depth and providing a flowpath to the selected depth;

(b) a second capillary tube positioned within the first capillary tube, the second capillary tube extending continuously from the surface to the selected depth and providing a flowpath for the tracer;

(c) a pressurized source at the surface, in fluid communication with the second capillary tube, the pressurized source for injecting the tracer into the second capillary tube; and (d) a tracer release port, in fluid communication with the second capillary tube, the tracer release port for releasing the tracer at the selected depth.

10. The apparatus of claim 9 additionally comprising:

(e) at least one sensor for detecting the presence of the released tracer, the sensor connected to the first capillary tube and suspended in the borehole at the selected depth.

11. The apparatus of claim 10 wherein the tracer release port comprises one or more valves.

12. The apparatus of claim 11 wherein one valve is located at the downhole end of the second capillary tube.

13. The apparatus of claim 10 wherein the sensor is a gamma radiation detector.

14. The apparatus of claim 10 additionally comprising:

(f) a source of electrical power, the electrical power for operating the sensor.

15. The apparatus of claim 14 wherein the source of electrical power is a battery.

16. The apparatus of claim 14 wherein the source of electrical power is comprised of at least one electrical wire positioned within the first capillary tube and extending from the surface to the sensor.

17. The apparatus of claim 16 additionally comprising:

(g) a third capillary tube, inserted in the first capillary tube, the third capillary tube extending from the surface to the sensor at the selected depth, the third capillary tube encapsulating the electrical wire.

18. The apparatus of claim 17 additionally comprising:

(h) a pressurized source at the surface, in fluid communication with the first capillary tube, the pressurized source for injecting a fluid in the first capillary tube to the selected depth.

19. Apparatus for continuously injecting a tracer in a borehole, the apparatus comprising:

(a) a housing defining a cavity, the housing having a first aperture for receiving a first connector and a second aperture for receiving a second connector, the first and second connectors affixed to the housing and extending into the housing cavity;

(b) a first capillary tube having an annulus for encapsulating a second capillary tube, the first capillary tube sealably affixed to and extending from the first connector to a selected depth in the borehole; and (c) a second capillary tube for transporting the tracer element, the second capillary tube in fluid communication with the second connector, the second capillary tube sealaby affixed to and extending from the second connector through the first capillary tube to the selected depth.

20. The apparatus of claim 19 additionally comprising:

(d) at least one sensor for detecting the presence of the released tracer, the sensor connected to the first capillary tube and suspended in the borehole at the selected depth.

21. The apparatus of claim 20 additionally comprising:

(e) a source of electrical power, the electrical power for operating the sensor.

22. The apparatus of claim 21 wherein the source of electrical power is a battery.

23. The apparatus of claim 21 wherein the housing includes a third aperture for receiving a third connector, the apparatus additionally comprising:

(e) the third connector, sealably affixed to the third aperture and extending into the housing cavity;

(f) a third capillary tube for receiving an electrical wire, the third capillary tube sealably affixed to and extending from the third connector through the first capillary tube to the selected depth in the borehole; and wherein the source of electrical power is the electrical wire extending from the third connector through the third capillary tube to the selected depth.

24. The apparatus of claim 23 wherein the housing includes a fourth aperture for sealably receiving a pressure fitting, the pressure fitting for injecting a fluid under pressure into the cavity of the housing, the housing in fluid communication with the annulus of the first capillary tube and providing a flowpath for the fluid extending from the housing to the selected depth.

25. The apparatus of claim 20 wherein the sensor is a gamma radiation detector.

26. A method for continuously injecting and detecting the presence of a tracer in a borehole, the method comprising:

(a) simultaneously inserting a first capillary tube, a second capillary tube and a sensor to a selected depth in the borehole, the second capillary tube positioned within the first capillary tube, the second capillary tube providing a flowpath for the tracer;

(b) pressure injecting a first tube to the selected racer through the second capillary tube to the selected depth; and (c) detecting the presence of the released tracer with the sensor.

27. The method of claim 26 wherein the tracer element is radioactive.

28. The method of claim 26 wherein the step (c) comprises detecting the presence of the tracer with a gamma radiation detector.

29. The method of claim 26 wherein additionally comprising the step of:

(d) providing a source of electrical power for the sensor.

30. The method of claim 29 wherein step (d) comprises:

(i) inserting a second capillary tube within the first capillary tube, the second capillary tube for receiving an electrical wire, the second capillary tube extending continuously from the surface to the selected depth; and (ii) inserting the electrical wire from the surface through the second capillary tube to the selected depth.

31. The method of claim 26 wherein step (b) additionally comprises;

(iv) injecting in the first capillary tube a second fluid to the selected depth.

* * * * *

UNITED STATES PATENT AND TRADEMARK OFFICE

CERTIFICATE OF CORRECTION

PATENT NO. : 5,723,781
DATED : Mar. 3, 1998
INVENTOR(S) : Pruett et al.

It is certified that error appears in the above-indentified patent and that said Letters Patent is hereby corrected as shown below:

In the claims, column 8, line 33, delete "tube to the selected racer" and replace with --fluid containing the tracer--.

In the claims, column 8, line 44, delete "wherein".

Signed and Sealed this

Sixteenth Day of June, 1998

*Attest:*

*Attesting Officer*

Bruce Lehman

BRUCE LEHMAN

*Commissioner of Patents and Trademarks*